US011072509B2

(12) United States Patent
Lo et al.

(10) Patent No.: US 11,072,509 B2
(45) Date of Patent: Jul. 27, 2021

(54) MEDIA STOPS

(71) Applicant: Hewlett-Packard Development Company, L.P., Spring, TX (US)

(72) Inventors: Kevin Lo, Vancouver, WA (US); Daniel Fredrickson, Vancouver, WA (US); Tim Roels, Vancouver, WA (US); Brett Thomas Buchholtz, Vancouver, WA (US); Steven Brown, Vancouver, WA (US); Hunter Dane Cantrell, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/634,961

(22) PCT Filed: Jul. 31, 2017

(86) PCT No.: PCT/US2017/044650
§ 371 (c)(1),
(2) Date: Jan. 29, 2020

(87) PCT Pub. No.: WO2019/027416
PCT Pub. Date: Feb. 7, 2019

(65) Prior Publication Data

US 2020/0216283 A1 Jul. 9, 2020

(51) Int. Cl.
*B65H 31/02* (2006.01)

(52) U.S. Cl.
CPC ..... *B65H 31/02* (2013.01); *B65H 2301/4212* (2013.01); *B65H 2403/60* (2013.01); *B65H 2404/74* (2013.01)

(58) Field of Classification Search
CPC ..... B65H 31/02; B65H 2301/4212; B65H 2403/60; B65H 2404/74
See application file for complete search history.

(56) References Cited

U.S. PATENT DOCUMENTS 3,022,999 A * 2/1962 Mead ..... B65H 31/36 271/224
3,907,128 A * 9/1975 Cathers ..... B65G 49/068 414/788.9

(Continued)

FOREIGN PATENT DOCUMENTS

WO WO-2007094958 A1 8/2007

OTHER PUBLICATIONS

Dell 3333dn and 33325dn Laser MFP ~ User's Guide ~ http://www.sayresd.org/wp-content/ ~ 2015 ~ 303 pages.

*Primary Examiner* — Howard J Sanders
(74) *Attorney, Agent, or Firm* — HP Inc. Patent Department

(57) ABSTRACT

An example apparatus includes a media receiving portion having a leading edge receiving region and a trailing edge receiving region for receiving media traveling onto the media receiving portion in a direction from the trailing edge receiving portion the leading edge receiving portion. The example apparatus further includes a leading edge stop coupled to the media receiving portion at the leading edge receiving portion. The leading edge stop is resiliently coupled to the media receiving portion to bias against movement of the leading edge stop from a resting position.

7 Claims, 6 Drawing Sheets

(56) References Cited

U.S. PATENT DOCUMENTS

| | | | | |
|---|---|---|---|---|
| 4,036,087 | A * | 7/1977 | Braun | B21D 43/22 83/79 |
| 4,786,041 | A | 11/1988 | Acquaviva et al. | |
| 4,817,934 | A | 4/1989 | McCormick et al. | |
| 4,961,090 | A | 10/1990 | Grey, Jr. et al. | |
| 5,226,742 | A | 7/1993 | Pintar et al. | |
| 5,346,203 | A | 9/1994 | Stemmle | |
| 5,454,553 | A | 10/1995 | Firl | |
| 6,494,450 | B2 * | 12/2002 | Tsurumaki | B65H 31/02 271/224 |
| 7,300,053 | B2 * | 11/2007 | Asano | B65H 31/34 271/220 |
| 2011/0031673 | A1 | 2/2011 | Sugizaki | |
| 2014/0103603 | A1 | 4/2014 | Horita | |

* cited by examiner

MEDIA STOPS

BACKGROUND

Imaging systems, such as printers, generally include a stacking region for the collection of print media. The stacking region may be an output region where a user may receive the print media. In some examples, the print media may be collected for post processing, such as stapling, three-hole punching, etc. For large print jobs, the stacking region may collect a large stack of media for post processing or collection by a user.

BRIEF DESCRIPTION OF THE DRAWINGS

For a more complete understanding of various examples, reference is now made to the following description taken in connection with the accompanying drawings in which.

DETAILED DESCRIPTION

Various examples provide for improved stacking of media as it is delivered onto an output stack. In one example, a leading edge stop is provided on an output tray. A resilience arrangement allows the leading edge stop to absorb energy from a medium (e.g., sheet of paper) traveling onto the output tray. In various examples, the leading edge stop may pivot as it is struck by the leading edge of the medium. The resilience arrangement urges the leading edge stop back to its resting position, thus facilitating alignment of the stack of sheets onto the output tray.

As described above, in some examples, print media may be collected in a stacking region, such as an output tray. As the print media is output from an image forming portion, the multiple sheets in the stack of the print media may not be aligned. Thus, the stack of print media may be difficult to post-process without significant effort to align the sheets for post-processing. Various examples described herein facilitate alignment of the sheets of media in the stack in the output region.

Figure 1:
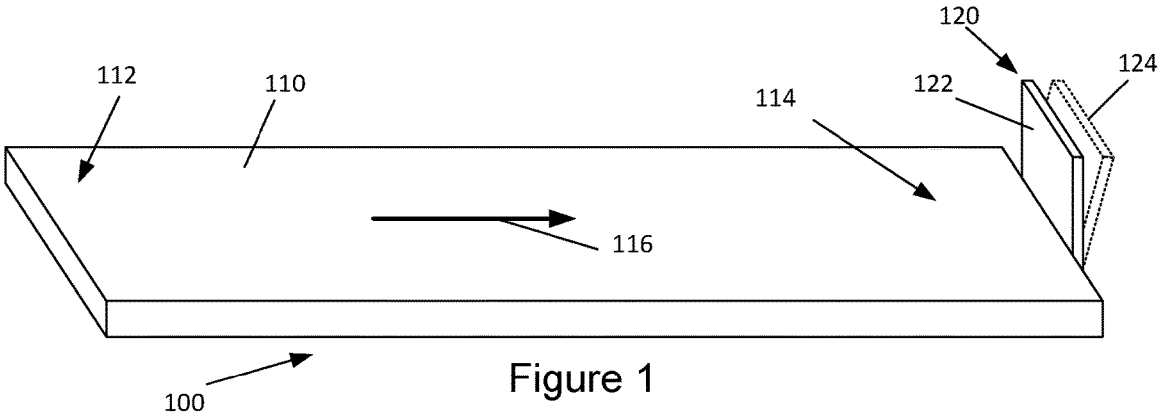
FIG. 1 is a perspective view of an example apparatus with a media stop.

Referring now to the figures, FIG. 1 illustrates a perspective view of an example apparatus with a media stop. The example apparatus 100 of FIG. 1 includes a media receiving portion 110. In various examples, the media receiving portion 110 may be an output tray of an imaging device, such as a printer, fax machine, copier or a multi-function device. As media, such as sheets of paper, are output by the imaging device, they may be stacked onto the media receiving portion 110.

The media receiving portion 110 has a trailing edge receiving region 112 on which the trailing edge of the medium is to rest and a leading edge receiving region 114 on which the leading edge of the medium is to rest as the medium travels in the direction 116. In this regard, in the example of FIG. 1, the medium may be output from the left and travel to the right.

The example apparatus 100 of FIG. 1 is provided with a leading edge stop 120 coupled to the media receiving portion 110. In various examples, the leading edge stop 120 is coupled to the media receiving portion 110 at the leading edge receiving portion 114. In the example apparatus 100 of FIG. 1, the leading edge stop 120 is coupled to the end of the leading edge receiving portion 114.

In various examples, the leading edge stop 120 is resiliently coupled to the media receiving portion 110 to bias against movement of the leading edge stop. As illustrated in the example of FIG. 1, the leading edge stop 120 may reside in a resting position 122 and may move to a displaced position 124. In this regard, the resilient coupling of the leading edge stop 120 biases against movement of the leading edge stop 120 from the resting position 122. Accordingly, when no external force is acting on the leading edge stop 120, the leading edge stop 120 remains in its resting position 122. When a force is applied to the leading edge stop 120, such as a print media striking the leading edge stop 120 as it is delivered to the media receiving portion 110, the leading edge stop 120 may be moved to or toward the displaced position 124. The resilient coupling may then urge the leading edge stop 120 back to its resting position 122.

As noted above, the coupling of the leading edge stop 120 to the media receiving portion 110 allows movement of the leading edge stop 120 relative to the media receiving portion 110. In the example apparatus 100 of FIG. 1, the allowed movement is a pivoting of the leading edge stop between the resting position 122 and the displaced position 124. In other examples, the movement may be translation along the direction 116 of delivery of the media.

Figure 2:
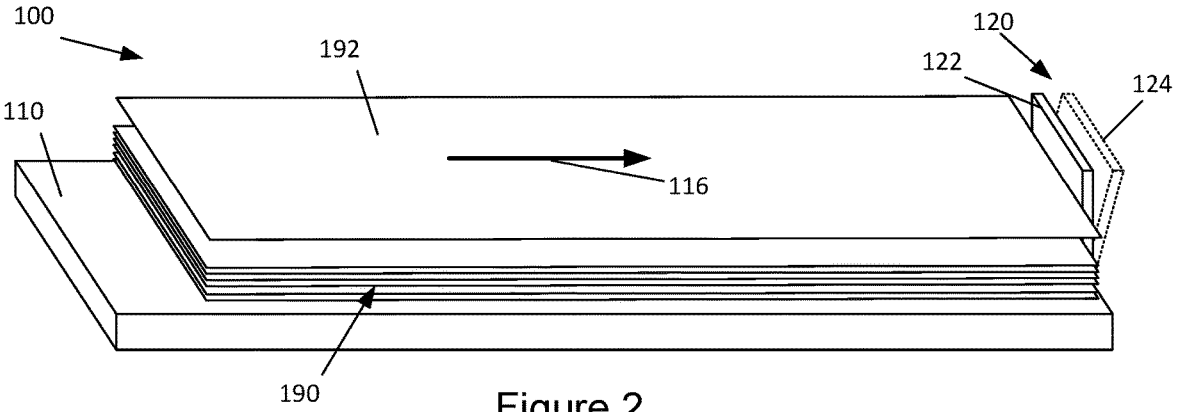
FIG. 2 is a perspective view of the example apparatus of FIG. 1 with a stack of media.

Referring now to FIG. 2, the example apparatus of FIG. 1 is illustrated with a stack 190 of media received on the media receiving portion 110. FIG. 2 further illustrates an additional sheet 192 arriving onto the media receiving portion 110. As the additional sheet 192 is delivered to the media receiving portion 110, movement of the additional sheet 192 is terminated when the leading edge of the additional sheet 192 strikes the leading edge stop 120. The resilient coupling of the leading edge stop 120 to the media receiving portion 110 may absorb the energy from the additional sheet, and cause the additional sheet to come to a rest on the stack 190. In this regard, the resilient coupling may limit the bouncing back of the additional sheet upon striking the leading edge stop 120.

Figure 3:
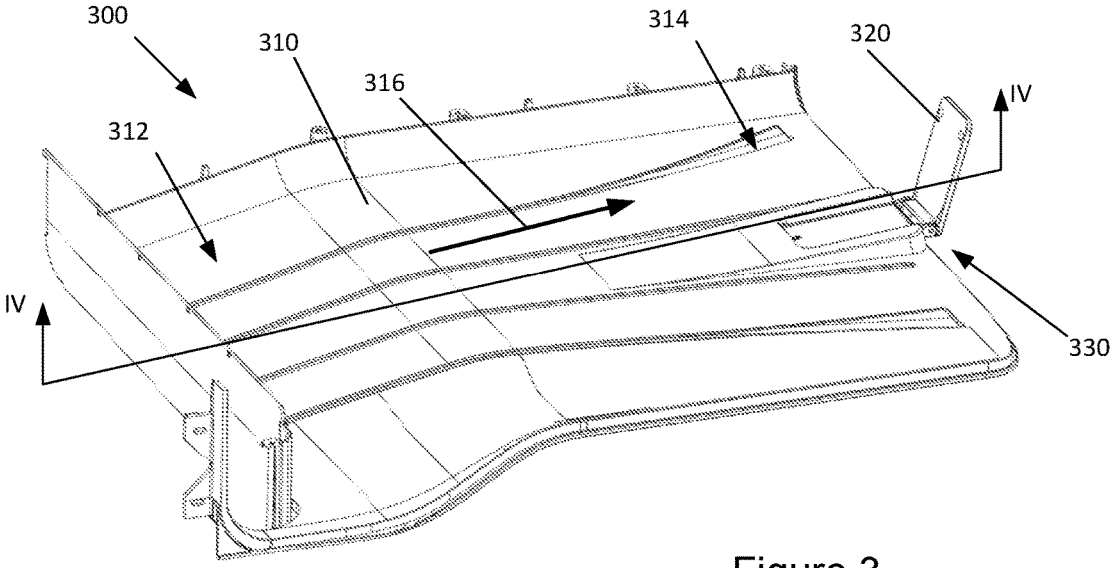
FIG. 3 is a perspective view of another example apparatus with a media stop.
Figure 4:
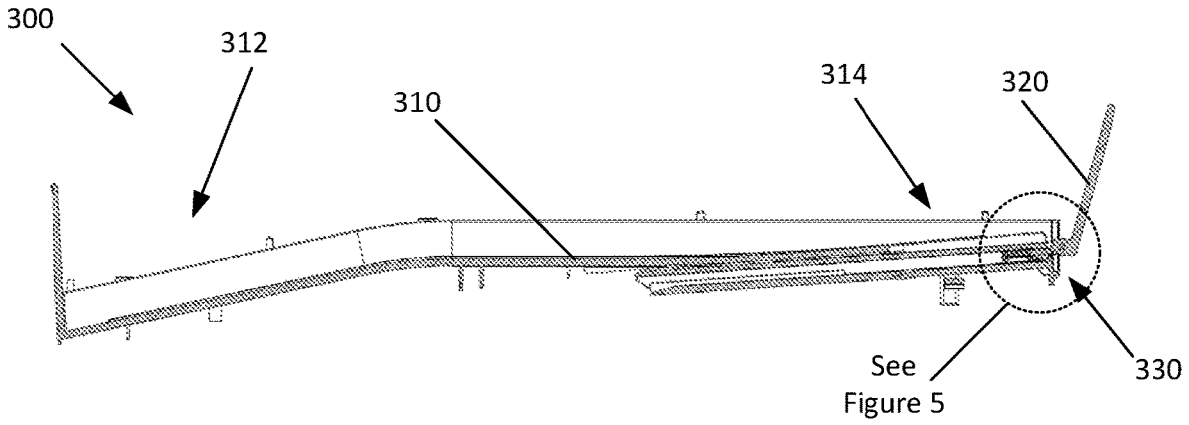
FIG. 4 is a cross-sectional view of the example apparatus of FIG. 3 taken along IV-IV.

Referring now to FIGS. 3 and 4, FIG. 3 illustrates a perspective view of another example apparatus with a media stop, and FIG. 4 illustrates a cross-sectional view taken along IV-IV of FIG. 3. The example apparatus 300 of FIGS. 3 and 4 is similar to the example apparatus 100 described above with reference to FIGS. 1 and 2 and includes a media receiving portion 310 and a leading edge stop 320. The media receiving portion 310 of the example apparatus 300 includes a trailing edge receiving portion 312 and a leading edge receiving portion 314 to receive corresponding portions of media as it is received traveling in the direction 316 illustrated in FIG. 3. In the example system 300 of FIGS. 3 and 4, the leading edge stop 320 and the media receiving portion 310 are coupled with a resilience arrangement 330, which is illustrated in detail in FIG. 5.

Figure 5:
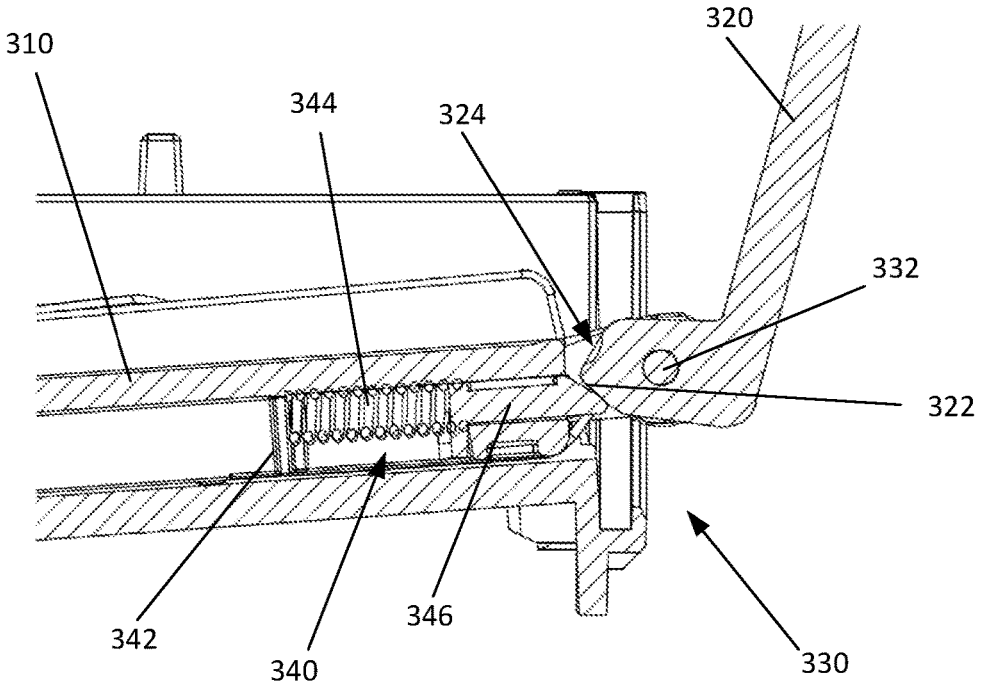
FIG. 5 is a detailed view of the highlighted portion of FIG. 4.

Referring now to FIG. 5, the resilience arrangement 330 is provided at the coupling of the media receiving portion 310 and the leading edge stop 320. In the example of FIG. 5, the media receiving portion 310 and the leading edge stop 320 are coupled at a pivot point 332 which allows the leading edge stop 320 to pivot relative to the media receiving portion 310. The resilience arrangement 330 is provided with a resilient portion 340 to provide resilience against pivoting of the leading edge stop 320. In the example of FIG. 5, the resilient portion 340 includes an anchor 342 secured to the media receiving portion 310. The resilient portion 340 further includes a resilient member 344 (e.g., compression spring) which forces a plunger 346 against a contact surface 322 of the leading edge stop 320. Thus, as the leading edge stop 320 pivots away from the resting position shown in FIG. 5, the resilient portion 340 urges the leading edge stop 320 back toward the resting position. In various examples, the resting position may be at a predetermined angle from the vertical. For example, in the resting position, the leading edge stop 320 may be at an angle of between about 5 degrees and about 30 degrees from the vertical. In one particular example, the leading edge stop 320 is at an angle of about 10 degrees from the vertical.

Figure 6:
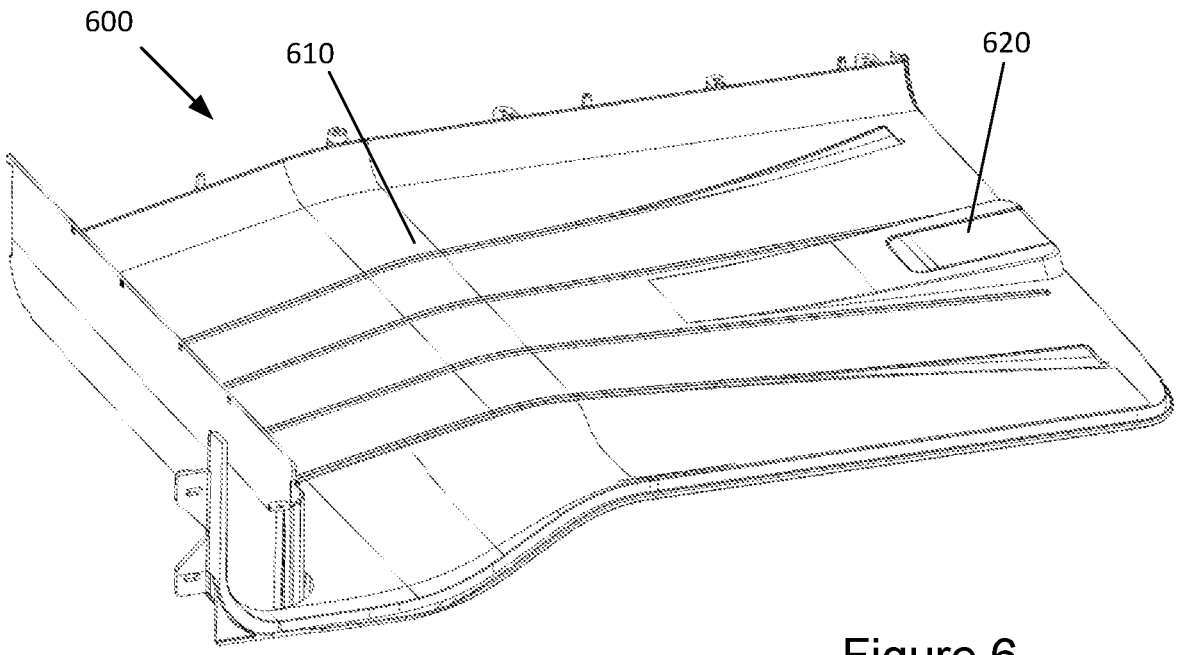
FIG. 6 is a perspective view of another example apparatus with a media stop.

In various examples, the leading edge stop may be foldable to an inactive position. In this regard, FIG. 6 illustrates a perspective view of another example apparatus 600 with a media stop. The example apparatus of FIG. 6 is similar to the example apparatus 300 described above with reference to FIGS. 3-5 and includes a media receiving portion 610 and a leading edge stop 620. In the example of FIG. 6, the leading edge stop 620 is shown in a folded down position. In this regard, the leading edge stop 620 is folded into the media receiving portion 610. The folding down of the leading edge stop 620 may be understood with reference to the resilience arrangement 330 illustrated in FIG. 3. When the leading edge stop 620 is folded down, the plunger 346 may engage the detent 324 in the leading edge stop 620 to secure the leading edge stop 620 in the folded down position illustrated in FIG. 6. The leading edge stop 620 may be removed with manual force from the folded down position, releasing the plunger 346 from the detent 324. In some examples, a torsion spring (not shown) may be provided in the pivot point 332 to facilitate return of the leading edge stop 620 to the resting position shown in FIG. 5.

Figure 7:
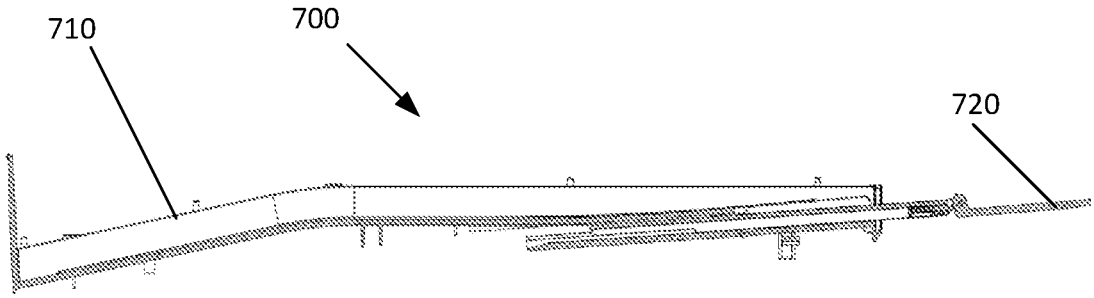
FIG. 7 is a cross-sectional view of another example apparatus with a media stop.

In another example apparatus 700 illustrated in FIG. 7, the leading edge stop 720 is folded outward from the media receiving portion 710. Similar to the example of FIG. 6, in some examples, a torsion spring (not shown in FIG. 7) may be provided at the pivot point (e.g. pivot point 332 of FIG. 5) where the leading edge stop 720 is coupled to the media receiving portion 710. In this regard, the leading edge stop 720 may be moved out of the way (e.g., to the position shown in FIG. 7) by a user as the stack of media is removed. The torsion spring may cause the leading edge stop 720 to return to the resting position shown in FIG. 4, for example. Thus, in each of the examples of FIGS. 6 and 7, with the application of sufficient manual force, the leading edge stop 620, 720 may be folded in either direction. With the leading edge stop 620, 720 in the folded, inactive position shown in FIGS. 6 and 7, a stack of media on the media receiving portion may be more easily accessible.

Figure 8:
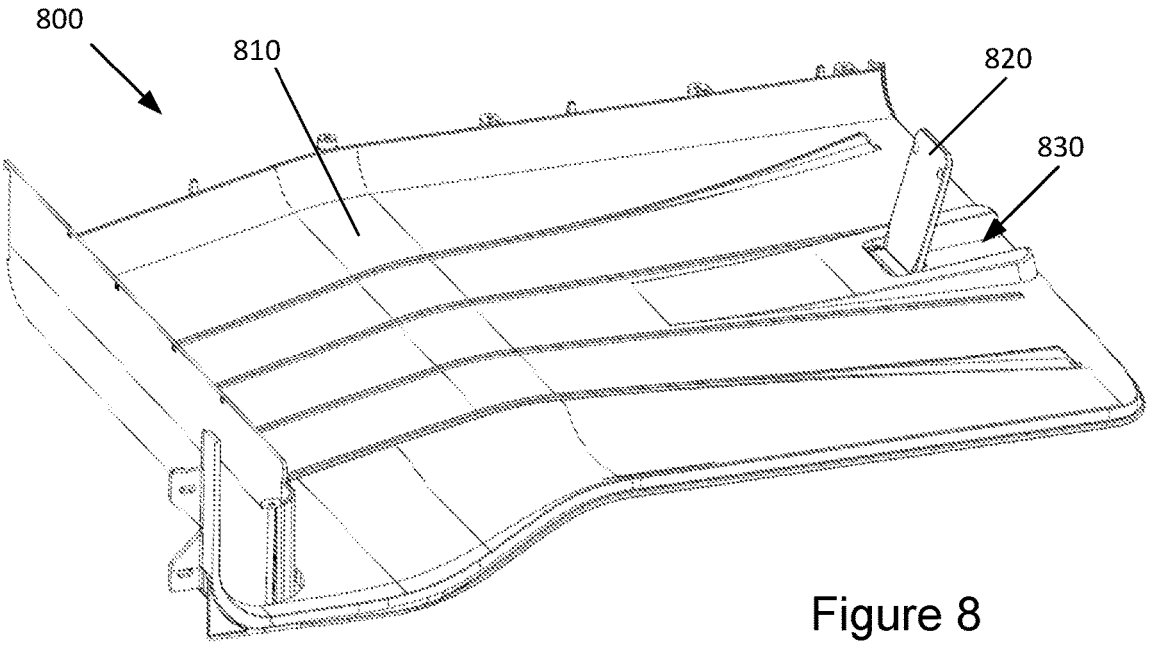
FIG. 8 is a perspective view of another example apparatus with a media stop.

In various examples, the leading edge stop may be selectively positionable to a variety of positions. In this regard, various different sizes of media (e.g., letter, A4, legal, etc.) may be accommodated. In this regard, FIG. 8 illustrates a perspective view of another example apparatus 800. The example apparatus 800 of FIG. 8 is similar to the examples described above and includes a media receiving portion 810 and a leading edge stop 820. The leading edge stop 820 of the example apparatus 800 is movable within a track 830 formed in the media receiving portion 810. In the example of FIG. 8, the leading edge stop 820 is positioned at a shorter position than that illustrated in the examples of FIGS. 2-4.

Figure 9:
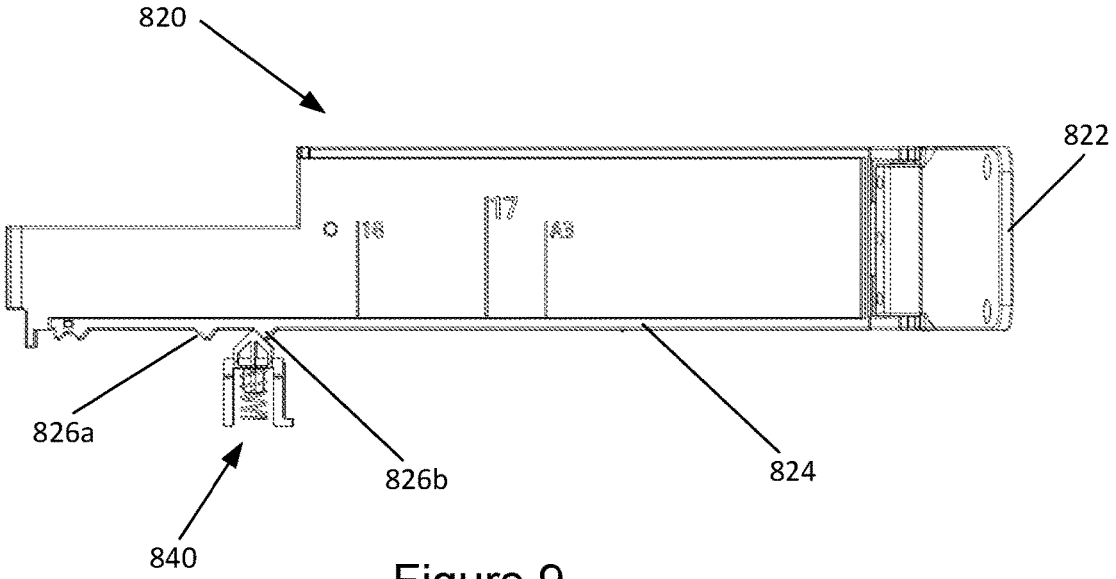
FIG. 9 is a top view of example media stop of the example apparatus of FIG. 8.

Reference is now made to FIG. 9 to more clearly illustrate an example of the leading edge stop 820 which is selectively positionable to one of at least two positions. FIG. 9 illustrates a top view of the leading edge stop 820 of the example apparatus 800 of FIG. 8. In the example of FIG. 9, the leading edge stop 820 includes a vertical stop portion 822 and a horizontal slide portion 824. The horizontal slide portion 824 may slide into a cavity formed in the media receiving portion 810. The horizontal slide portion 824 is provided with protrusions 826*a, b*, with each protrusion 826*a, b* corresponding to a different position and a different media size. The protrusions 826*a, b* may engage a latching mechanism 840 which may be provided within the cavity in the media receiving portion 810. A user may manually exert sufficient force to overcome the latching mechanism to selectively position the slide portion 824 at the desired position. In various examples, a resilient member (not shown in FIG. 9), such as a compression spring, may be provided to urge the slide portion 824 toward the protrusion 826*a,b*. For example, a user may push or pull the slide portion 824 to the desired position, but may not precisely position the slide for the desired media size. The resilient member may urge the slide portion 824 such that the latching mechanism 840 comes into contact with the protrusion 826*a,b*. In the example of FIG. 9, a user may position the slide portion 824 such that the latching mechanism 840 is between the two protrusions 826*a,b*, and the resilient member may urge the slide portion 824 (to the left in FIG. 9) to cause the latching mechanism 840 to come into contact with the protrusion 826*b*, corresponding to the desired media size.

Figure 10:
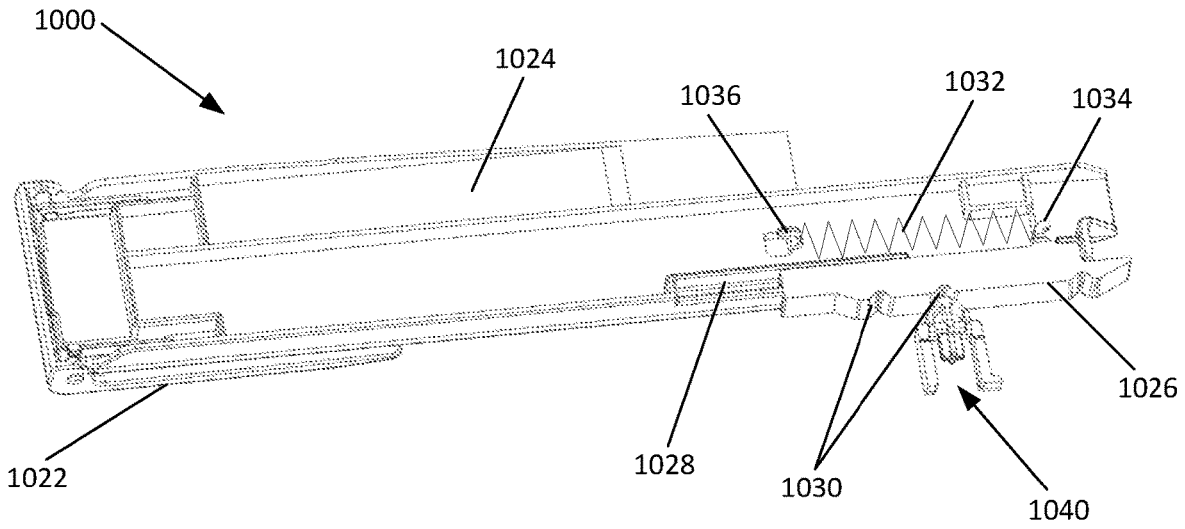
FIG. 10 is a perspective view of another example media stop in an extended position.
Figure 11:
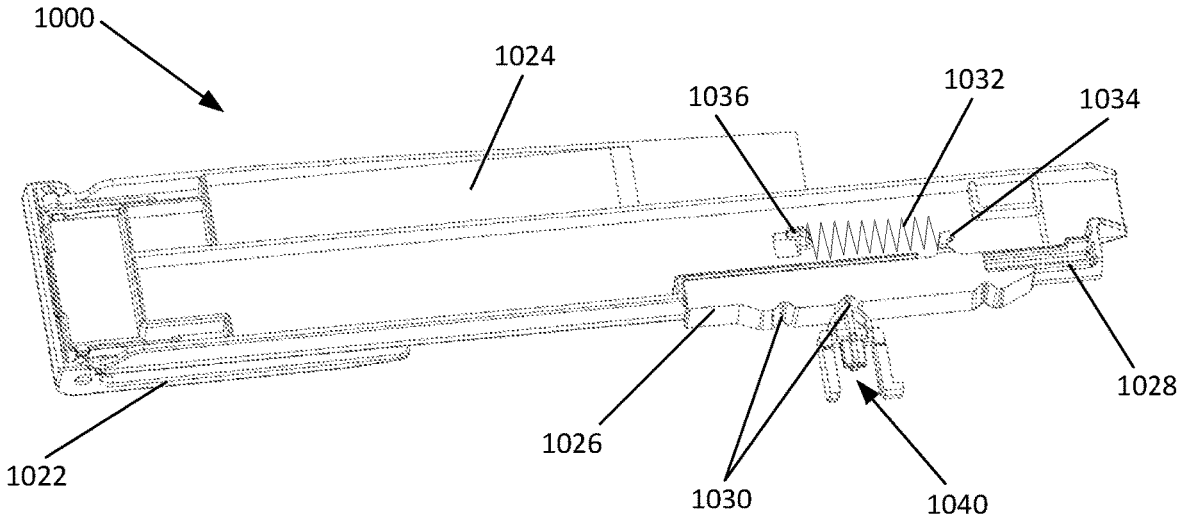
FIG. 11 is a perspective view the example media stop of FIG. 10 in a relaxed position.

FIGS. 10 and 11 illustrate another example leading edge stop 1000. The example leading edge stop 1000 is similar to the example leading edge stop 820 of FIG. 9 and includes a vertical stop portion 1022 and a horizontal slide portion 1024. In the example illustrated in FIGS. 10 and 11, the vertical stop portion 1022 is shown in the folded down position described above with reference to FIG. 6.

The example leading edge stop 1000 of FIGS. 10 and 11 includes a slider 1026 coupled to a track 1028 formed on the slide portion 1024. The slider 1026 includes notches 1030 formed thereon to engage a latching mechanism 1040, similar to the latching mechanism 840 described above with reference to FIG. 9, which may be provided within a cavity in the media receiving portion. The slider 1026 allows movement of the slide portion 1024 independent of the latching of the latching mechanism 1040 to a desired one of the indents 1030. Thus, if a user desires to remove a stack of media, the slide portion 1024 and the stop portion 1022 may be pulled out without unlatching of the latching mechanism 1040.

To facilitate return of the slide portion 1024 and the stop portion 1022 to the position corresponding to the desired media size, a resilient member, such as a compression spring 1032, may be provided. In the example of FIGS. 10 and 11, the compressing spring 1032 is coupled to the slider 1026 at a hook 1034 and to the slide portion 1024 at a hook 1036. When the user pulls the slide portion 1024 and the stop portion 1022 to, for example, remove a stack of media, the compression spring 1032 is in an extended position, as illustrated in FIG. 10. After removal of the stack of media, the user may release the slide portion 1024 and the stop portion 1022. The compression spring 1032 may then cause the slide portion 1024 and the stop portion 1022 to return to the desired position, as illustrated in FIG. 11.

Figure 12:
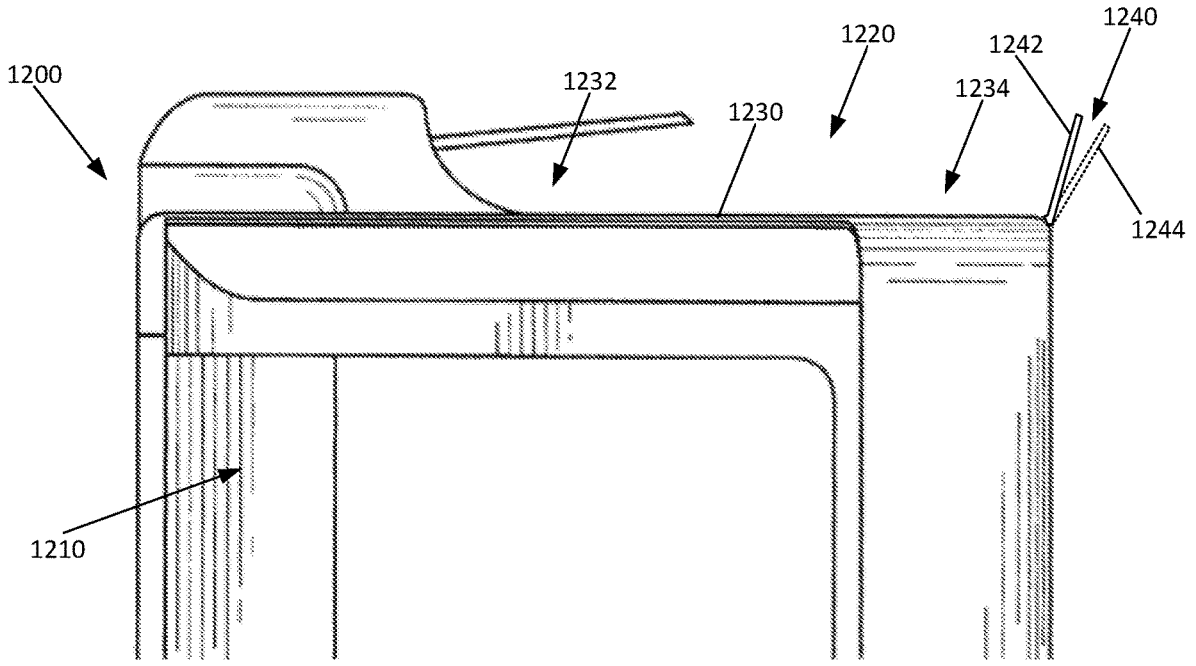
FIG. 12 is a side view of an example system.

Referring now to FIG. 12, an example system 1200 is illustrated with an imaging portion 1210 and a media output portion 1220. In various examples, the example system 1200 may be an imaging system for use in home, office or other environments. In this regard, the imaging portion 1210 of the example system 1200 may include various components to form an image on print media. For example, the imaging portion 1210 may include an inkjet mechanism to form the image on a sheet of paper. Of course, the imaging portion 1210 may include various other components, including components to provide functionality for printing, scanning, copying or faxing, for example. In one example, the imaging portion 1210 is part of a multi-function device that includes components for at least two of the functions described above.

The media output portion 1220 of the example system 1200 includes a media receiving portion 1230 for receiving media that may be output by the media forming portion 1210. As the media is received in the media output portion 1220, the media may be traveling from left to right in FIG. 12. Thus, a leading edge of the media is received on a leading edge receiving region 1234 of the media receiving portion 1230, and a trailing edge of the media is received on a trailing edge receiving region 1232.

The media output portion 1220 further includes a leading edge stop 1240 that is coupled to the media receiving portion 1230. In this regard, the leading edge stop 1240 is positioned proximate to the leading edge receiving region 1234 of the media receiving portion. As describe above with reference to the various examples of FIGS. 1-11, the leading edge stop 1240 may be resiliently coupled to the media receiving portion 1230 to allow movement of the leading edge stop 1240 between a resting position 1242 and a displaced position 1244. In this regard, various examples of the media output portion may include a resilient member to bias against movement of the leading edge stop 1240 from the resting position 1242. One example of the resilient member is described above with reference to FIG. 5.

Figure 13:
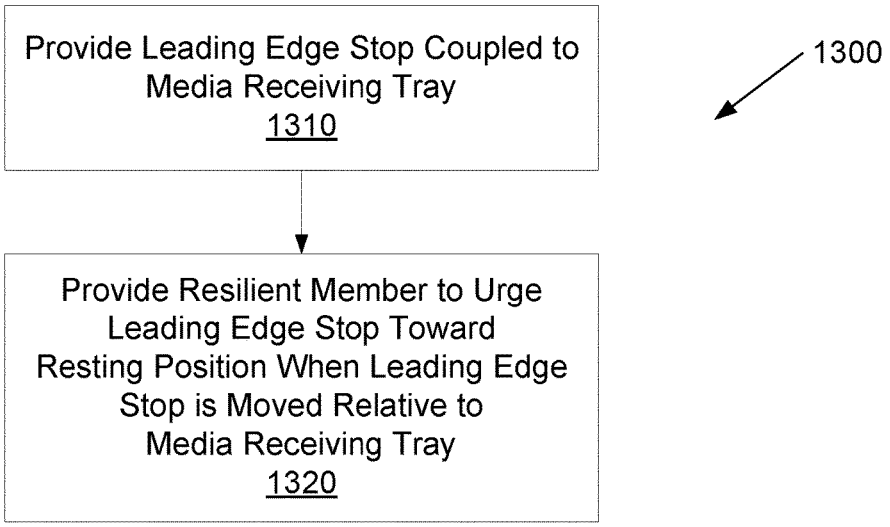
FIG. 13 is a flow chart illustrating an example method for forming an example apparatus.

Referring now to FIG. 13, a flow chart illustrates an example method for forming an example apparatus with a leading edge stop. The example method 1300 of FIG. 13 includes providing a leading edge stop coupled to a media receiving tray (block 1310). For example, as described above with reference to FIGS. 3 and 4, the media receiving portion 310 may be coupled to the leading edge stop 320. Referring again to FIG. 13, the example method 1300 further includes providing a resilient member (block 1320). The resilient member urges the leading edge stop toward a resting position when the leading edge stop is moved relative to the media receiving tray. For example, as described above with reference to FIG. 5, the resilient portion 340 includes a resilient member 344 which forces the plunger 346 against the contact surface 322 of the leading edge stop 320. Thus, as the leading edge stop 320 pivots away from the resting position, the resilient portion 340 urges the leading edge stop 320 back toward the resting position, which may be at a predetermined angle from the vertical, as described above.

Thus, in accordance with various examples described herein, media in an output region may be stacked with improved alignment.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. An apparatus, comprising:

a media receiving portion having a leading edge receiving region and a trailing edge receiving region for receiving media traveling onto the media receiving portion in a direction from the trailing edge receiving region to the leading edge receiving region; and a leading edge stop pivotally coupled to the media receiving portion at the leading edge receiving region, wherein the leading edge stop is resiliently biased against movement from a resting position, and further comprising a resilience arrangement to resiliently bias the leading edge stop against movement relative to the media receiving portion, wherein the resilience arrangement is to bias the leading edge stop in a first direction to rotate the leading edge stop in a second direction opposite the first direction, wherein the first direction is in the direction from the trailing edge receiving region to the leading edge receiving region.

2. The apparatus of claim 1, wherein the resilience arrangement includes a compression spring.

3. The apparatus of claim 1, wherein the leading edge stop is pivotally coupled to the media receiving portion at a pivot point to allow the leading edge stop to pivot relative to the media receiving portion, and wherein the resilience arrangement provides biasing against pivoting of the leading edge stop about the pivot point.

4. The apparatus of claim 1, wherein the leading edge stop is foldable to an inactive position such that the leading edge stop does not extend above the leading edge receiving region of the media receiving portion.

5. The apparatus of claim 1, wherein the leading edge stop is selectively positionable to one of at least two positions, each of the at least two positions corresponding to a different media size.

6. A method, comprising:

pivotally coupling a leading edge stop to a media receiving tray; and resiliently biasing the leading edge stop with a resilient member, including urging the leading edge stop toward a resting position with the resilient member when the leading edge stop is moved relative to the media receiving tray, wherein resiliently biasing the leading edge stop includes biasing the leading edge stop in a first direction to rotate the leading edge stop in a second direction opposite the first direction, wherein the first direction is a direction in which the media receiving tray is to receive media.

7. The method of claim 6, wherein the leading edge stop is pivotally coupled to the media receiving tray at a pivot point, and wherein urging the leading edge stop toward the resting position includes pivoting the leading edge stop about the pivot point.

* * * * *